US007407273B2

(12) United States Patent
Gau et al.

(10) Patent No.: US 7,407,273 B2
(45) Date of Patent: Aug. 5, 2008

(54) PIEZO-DRIVEN MICRO-DROPLET JET GENERATOR

(75) Inventors: Tien-Ho Gau, Hsinchu (TW); Yu-Yin Peng, Hsinchu (TW); Chin-Pin Chien, Taipei Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 276 days.

(21) Appl. No.: 11/058,456

(22) Filed: Feb. 14, 2005

(65) Prior Publication Data

US 2006/0132546 A1 Jun. 22, 2006

(51) Int. Cl.
*B41J 2/045* (2006.01)

(52) U.S. Cl. ..... 347/68; 347/70

(58) Field of Classification Search ..... 347/68–72
See application file for complete search history.

(56) References Cited

U.S. PATENT DOCUMENTS 5,184,155 A * 2/1993 Yonekubo et al. ..... 347/68
6,362,844 B1 * 3/2002 Shieh et al. ..... 347/70
6,557,985 B2 * 5/2003 Hosono et al. ..... 347/70

* cited by examiner

*Primary Examiner*—Stephen D Meier
*Assistant Examiner*—Geoffrey Mruk
(74) *Attorney, Agent, or Firm*—Pro-Techtor Int'l Services

(57) ABSTRACT

A piezo-driven micro-droplet jet generator comprises an ejection seat, having an ejection plate with a plurality of ejection holes; a membrane, having a front side facing the ejection seat and a rear side; a piezoelectric plate, placed at the rear side of the membrane, at least partly touching the membrane and, when electric voltage is applied, driving a vibrating movement of the membrane towards the ejection plate; a base plate, at four corners thereof fastened to the ejection seat and to the membrane; and a flow path inside the ejection seat, allowing liquid to be let into a space inside the ejection seat; wherein liquid between the membrane and the ejection plate upon the vibrating movement undergoes pressure, being ejected through the plurality of ejection holes.

11 Claims, 3 Drawing Sheets

PIEZO-DRIVEN MICRO-DROPLET JET GENERATOR

BACKGROUND OF THE INVENTION

1. Field of the Invention

The present invention relates to a piezo-driven micro-droplet jet generator, particularly to a micro-droplet jet generator having a piezo-driven membrane and a plurality of micro-sized holes through which droplets are ejected.

2. Description of Related Art

Microelectronic technology has made great progress in recent years and is subject of intensive research and development efforts. Micro-droplet jet generators have found wide use in ink-jet printers. Since ejection speed and flow are precisely controllable, further applications of micro-droplet jet generation technology are biotechnology, micro-coating, controlling of tiny jet quantities and scent generators.

Conventional micro-droplet jet generators are mainly of two types, thermal bubble and piezoelectric jet generators. Since the present invention relates to piezoelectric technology, thermal bubble jet generators will not be mentioned further.

A piezoelectric jet generator creates electrically generated vibrations of an amplitude and a high frequency, driving a compressing element in a pressing movement, leading to the ejection of liquid through tiny nozzles. Since piezoelectric jet generators do not operate by heating liquid, there is no risk of changes in the composition of the liquid and, as compared to thermal bubble jet generators, no subsequent damage after prolonged use will occur. Therefore, a wider range of biomedical and industrial applications is attained.

Conventional piezoelectric jet generators are still in need of improvement. First, a piezoelectric jet generator has a piezoelectric elements as a main structural part, which is made of piezoelectric material. However, if piezoelectric material is exposed to etching liquid for an extended time period, piezoelectric effect thereof is diminished to the point of damaging the piezoelectric element. Therefore, conventional piezoelectric jet generators are not usable in conjunction with etching liquid.

Furthermore, conventional piezoelectric jet generators have chambers between the nozzles and the piezoelectric element. Liquid that has flown into the chambers is ejected through the nozzles due to pressure generated by the piezoelectric element. In conventional art, however, the chambers are usually far wider than the amplitude of the vibrations of the piezoelectric element, so that the vibrations change the volume of the chambers only to a small degree and little pressure is generated. For ejecting droplets, the nozzles need to have minimum sizes, not allowing for ejection of micro-sized droplets.

SUMMARY OF THE INVENTION

It is the object of the present invention to provide a piezo-driven micro-droplet jet generator which is not damaged by etching liquid and which operates with higher pressure to allow for ejection of micro-sized droplets.

One main characteristic of one embodiment of the present invention lies in having a piezoelectric plate that is separated by a membrane from liquid, so that reactive liquids, such as etching liquid for example, will not damage the piezoelectric plate. Furthermore, in a rest state, the membrane touches an ejection plate. During a vibrating movement, a gap between the membrane and the ejection plate with varying width results. Due to the small width of the gap, the vibrating movement causes high pressure of liquid in the gap, driving out liquid through ejection holes in the ejection plate. Increased pressure allows for smaller ejection holes and an ejection of smaller droplets.

The present invention can be more fully understood by reference to the following description and accompanying drawings.

DETAILED DESCRIPTION OF THE PREFERRED EMBODIMENTS

Figure 1:
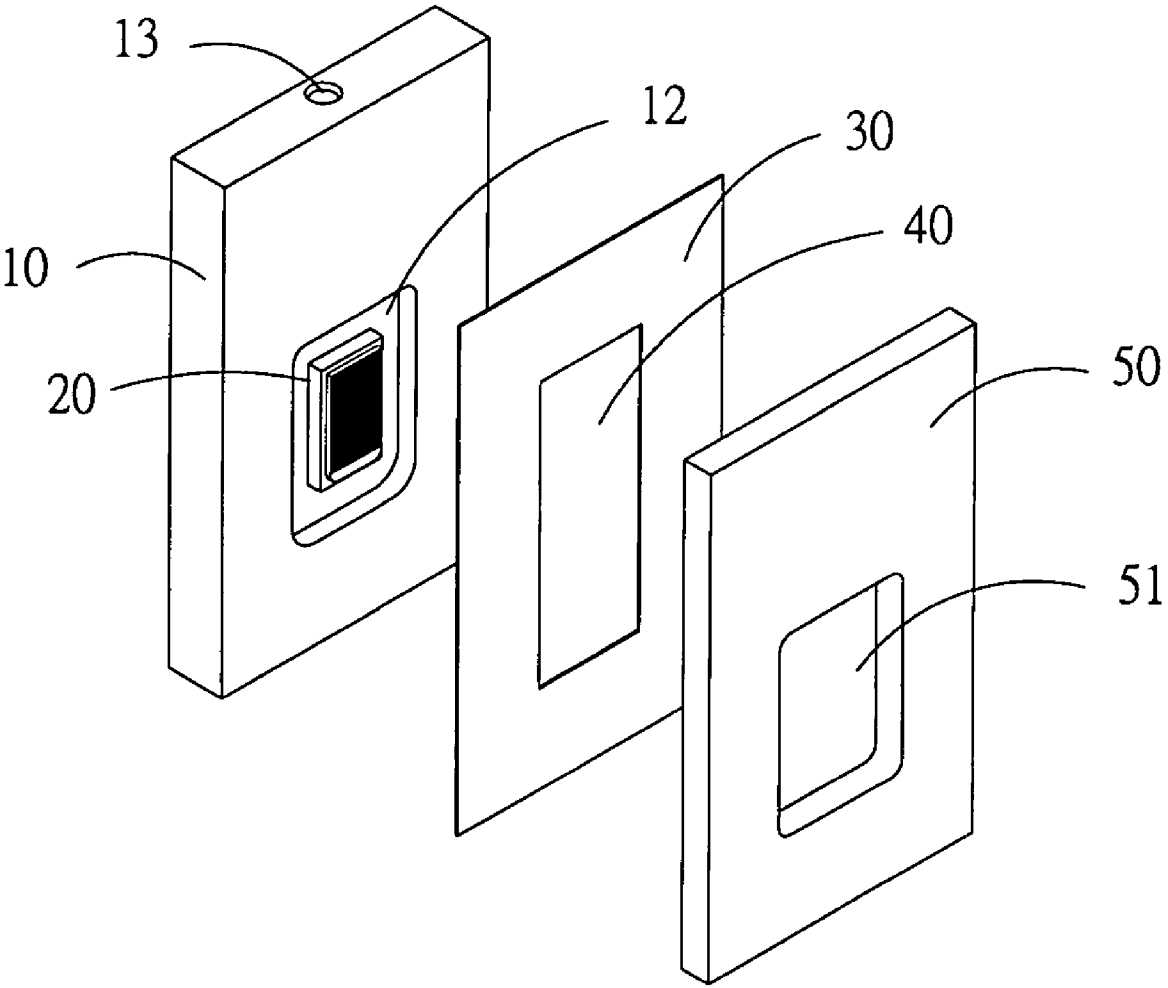
FIG. 1 is a perspective view of the piezo-driven micro-droplet jet generator of the present invention from the rear side.
Figure 2:
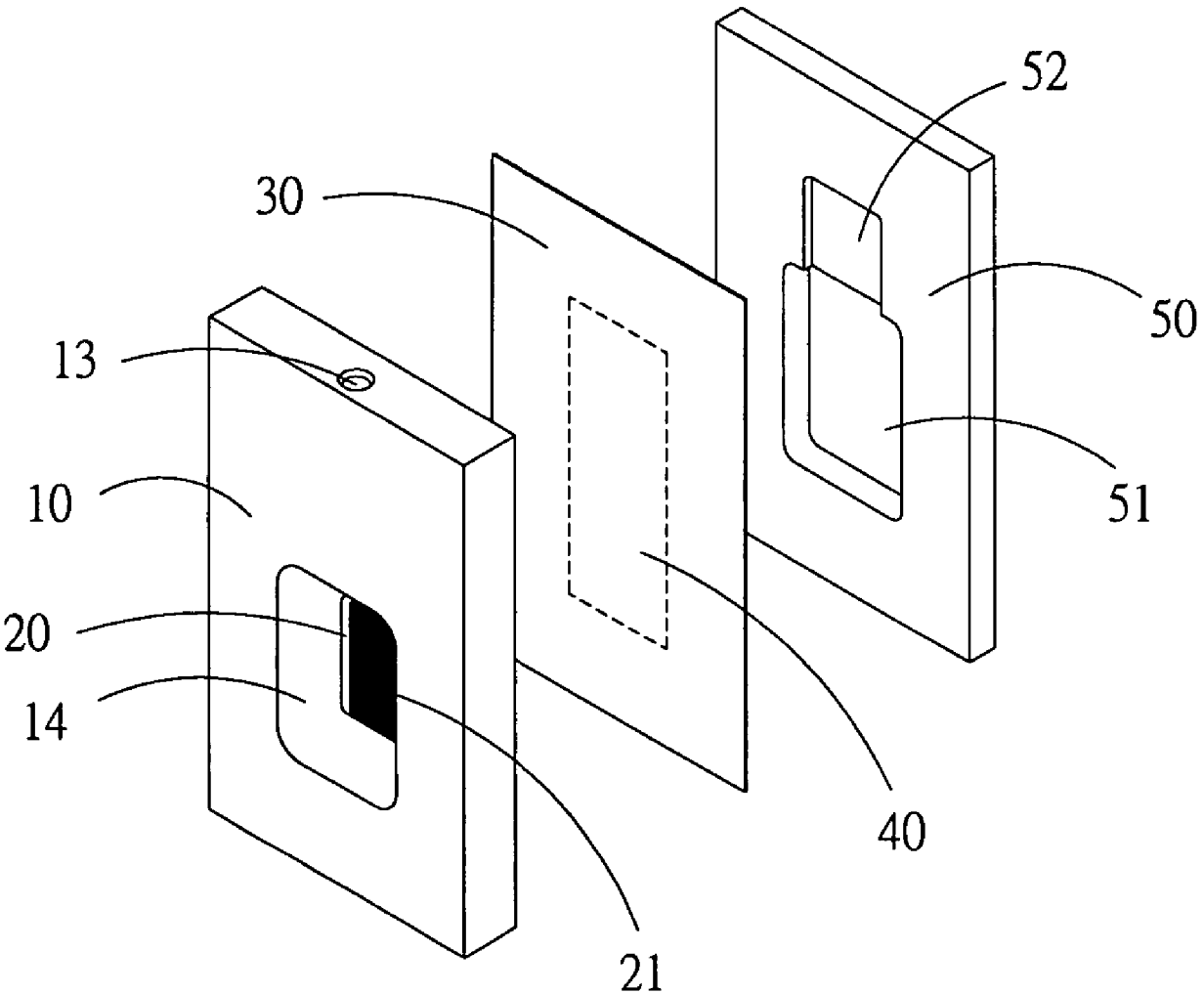
FIG. 2 is a perspective view of the piezo-driven micro-droplet jet generator of the present invention from the front side.

As shown in FIGS. 1 and 2, the piezo-driven micro-droplet jet generator of the present invention comprises: an ejection seat 10; an ejection plate 20; a membrane 30; a piezoelectric plate 40; and a base plate 50.

The ejection seat 10 has a discharge hole 14 in a central position, accommodating the ejection plate 20. The ejection plate 20 is a flat plate having a plurality of ejection holes 21, through which a liquid is ejected. A flow path runs inside the ejection seat 10, having a ejection chamber 12 around the ejection plate 20 and an inlet 13 connecting the ejection chamber 12 with an outer side of the ejection seat 10. Liquid entering the inlet 13 from the outside is thus allowed to flow to the ejection chamber 12 and further to a gap between the ejection plate 20 and the membrane 30.

Figure 3:
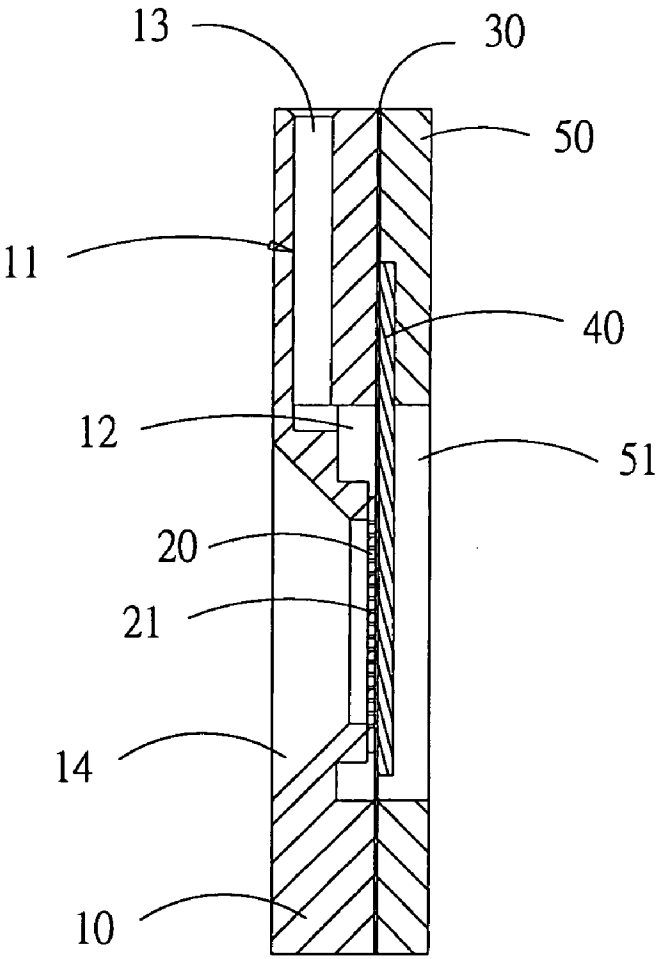
FIG. 3 is a cross-sectional view of the piezo-driven micro-droplet jet generator of the present invention.

As shown in FIGS. 2-3, the membrane 30 is placed between the ejection seat 10 and the base plate 50, having a front side facing the ejection plate 20 and a rear side. The piezoelectric plate 40 is mounted at the rear side of the membrane 30, touching the membrane 30 at least partly and causing the membrane 30 to perform a vibrating movement towards said ejection plate.

Referring again to FIG. 2, the base plate 50 has an opening 51 and a holding groove 52. The piezoelectric plate 40 is partly laid into the holding groove 52 at a fixed end thereof, with a free end extending into the opening 51. The fixed end of the piezoelectric plate 40 touches the membrane 30. If electric voltage is applied to the piezoelectric plate 40, the piezoelectric plate 40 vibrates, causing the membrane 30 to perform the vibrating movement, so that liquid between the membrane 30 and the ejection plate 20 is exposed to pressure and escapes through the ejection holes 21.

Figure 4:
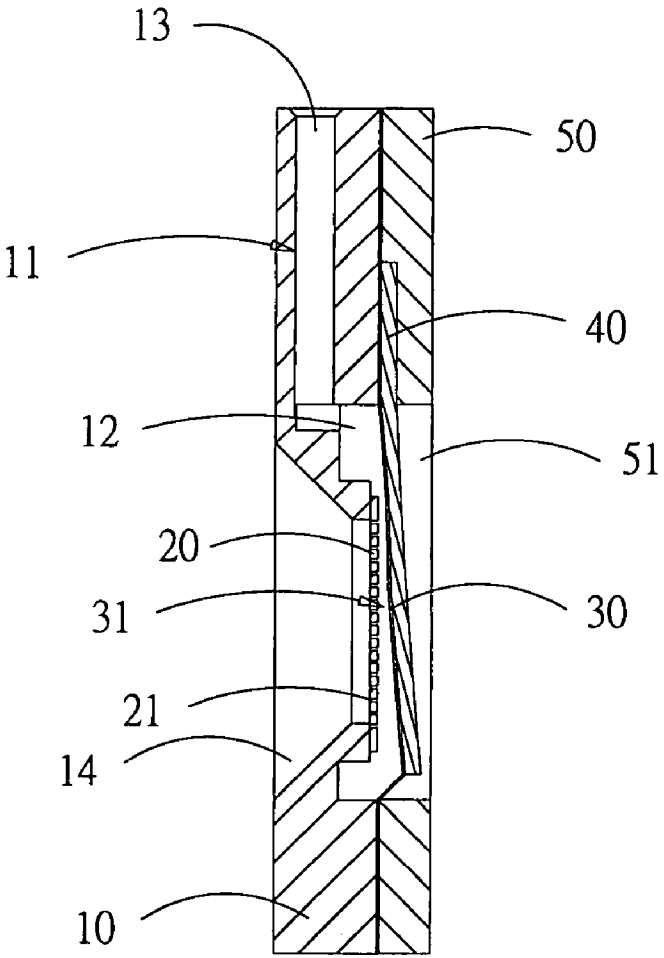
FIG. 4 is a cross-sectional view of the piezo-driven micro-droplet jet generator of the present invention during the vibrating movement.

One main characteristic of a further embodiment of the present invention lies in relative positions of the ejection plate 20, the membrane 30 and the piezoelectric plate 40, which are mutually parallel. As shown in FIGS. 3-4, the pathway 12 in the ejection seat 10 and the ejection plate 20 are located at the front side of the membrane 30, whereas the piezoelectric plate 40 is placed at the rear side of the membrane 30. Therefore, the piezoelectric plate 40 is separated from liquid by the membrane 30 and will not be damaged if reactive liquid is used. This allows use of etching liquid without risk of damaging the piezoelectric plate 40.

Another characteristic of the present invention lies in that the ejection plate 20 and the membrane 30 are oriented parallel to each other, with a gap 31 left in between. During the vibrating movement, the gap 31 has a varying width. In a rest state, the membrane 30 touches the ejection plate 20. During the vibrating movement, upon changing the frequency thereof, a resonance frequency is reached. Then the vibrating movement has a large amplitude, so that the gap 31 is widened and a connection between the gap 31 and the pathway 12 of the ejection seat 10 is established. At this time, liquid is drawn from the pathway 12 into the gap 31 by capillary forces. The vibrating movement of the membrane 30 caused by the piezoelectric plate 40 vibrating compresses liquid in the gap 31, causing liquid to be ejected through the ejection holes 21 in the ejection plate 20.

As the above explanation shows, the present invention avoids damaging of the piezoelectric plate by etching liquid. Furthermore, the present invention operates at increased ejection pressure, allowing smaller droplets to be ejected, achieving a wider range of applications.

While the invention has been described with reference to preferred embodiments thereof, it is to be understood that modifications or variations may be easily made without departing from the spirit of this invention which is defined by the appended claims.

The invention claimed is:

1. A piezo-driven micro-droplet jet generator, comprising:

an ejection seat, having an a discharge hole in a central portion thereof opening to surroundings exterior to said generator, an inlet for liquid, and an ejection chamber, inside said ejection seat, in fluidic communication with said inlet, said ejection chamber containing an ejection plate having a plurality of micro ejection holes and positioned between said ejection chamber and said discharge hole;

a base plate fastened to said ejection seat;

a membrane between said ejection seat and said base plate, having a front side facing said ejection seat and a rear side, with the membrane touching the ejection plate in a rest state; and a piezoelectric plate, placed at said rear side of said membrane, covering said ejection plate, such that said piezoelectric plate is completely separated from said liquid by said membrane;

wherein when electric voltage is applied, said piezoelectric plate vibrates in cantilever bending, during said vibrating movement a gap opens between said membrane and said ejection plate, liquid between said membrane and said ejection plate upon said vibrating movement undergoes pressure, and is ejected through said plurality of micro ejection holes.

2. The piezo-driven micro-droplet jet generator according to claim 1, wherein said piezoelectric plate has a cantilever mounting with a fixed end mounted on said base plate and a free end covering said ejection plate and, when electric voltage is applied, vibrates in cantilever bending driving said vibrating movement of said membrane towards said ejection plate.

3. The piezo-driven micro-droplet jet generator according to claim 1, wherein said space inside said ejection seat is a pathway surrounding said ejection plate and said flow path further comprises an inlet connecting an outside open space with said pathway.

4. The piezo-driven micro-droplet jet generator according to claim 3, wherein liquid enters a gap between said membrane and said ejection plate through said pathway.

5. The piezo-driven micro-droplet jet generator according to claim 1, wherein said membrane, said piezoelectric plate, and said ejection plate are oriented parallel to each other.

6. The piezo-driven micro-droplet jet generator according to claim 1, wherein during said vibrating movement a gap opens between said membrane and said ejection plate.

7. The piezo-driven micro-droplet jet generator according to claim 1, wherein said ejection chamber further comprises a pathway surrounding said ejection plate.

8. The piezo-driven micro-droplet jet generator according to claim 7, wherein an inlet connects an outside open space with said pathway.

9. The piezo-driven micro-droplet jet generator according to claim 7, wherein an inlet connects an outside open space with said pathway.

10. The piezo-driven micro-droplet jet generator according to claim 1, wherein said base plate has an opening and a holding groove.

11. The piezo-driven micro-droplet jet generator according to claim 1, wherein said fixed end of said piezoelectric plate is laid in said holding groove and said free end of said piezoelectric plate extends into said opening.

* * * * *